US006636705B2

(12) United States Patent
Fischer

(10) Patent No.: US 6,636,705 B2
(45) Date of Patent: Oct. 21, 2003

(54) METHODS AND APPARATUS FOR DETECTING TONER FADE IN AN IMAGING DEVICE

(75) Inventor: Todd A. Fischer, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/766,901

(22) Filed: Jan. 18, 2001

(65) Prior Publication Data

US 2002/0094209 A1 Jul. 18, 2002

(51) Int. Cl.[7] ..... G03G 15/08
(52) U.S. Cl. ..... 399/27; 399/49; 399/55
(58) Field of Search ..... 399/27, 28, 29, 399/49, 53, 55

(56) References Cited

U.S. PATENT DOCUMENTS 5,162,874 A * 11/1992 Bulter ..... 356/446
5,469,244 A * 11/1995 Ogsta et al. ..... 399/27
6,006,048 A * 12/1999 Folkins ..... 399/55

FOREIGN PATENT DOCUMENTS

JP 7-3655 * 4/1985

* cited by examiner

*Primary Examiner*—Quana M. Grainger

(57) ABSTRACT

Methods and apparatus for detecting a low toner condition in a color laser printer are disclosed. The invention generally includes at least one energy detector which can detect relative intensity of electromagnetic energy reflected from at least one toner area. A variation in the intensity of reflected energy, either from a reference value, or within a single toner area, or between two toner areas, can indicate toner fade due to a low toner condition. Apparatus in accordance with the present invention can also include a movable support surface which can support at least one toner area. Apparatus can also include at least one of various configurations of energy sources which can be configured to produce electromagnetic energy and direct the energy toward the toner area. A method in accordance with the present invention can include detecting intensity of electromagnetic energy reflected from at least one toner area.

19 Claims, 6 Drawing Sheets

METHODS AND APPARATUS FOR DETECTING TONER FADE IN AN IMAGING DEVICE

FIELD OF THE INVENTION

This invention pertains to color laser imaging methods and apparatus and, in particular, to methods and apparatus for detecting a low toner condition in color laser imaging devices.

BACKGROUND OF THE INVENTION

Color printing by an electrophotographic printer is achieved by first scanning a digitized image onto a photoconductor. Typically, the scanning is performed with diodes which pulse a beam of energy onto the photoconductor. The diodes can be, for example, laser diodes or light emitting diodes (LEDs). The photoconductor typically comprises a movable surface coated with a photoconductive material capable of retaining localized electrical charges. In many cases, the movable surface is in the form of a revolvable cylindrical drum.

The surface of the photoconductor is divided into relatively small units called pixels. The photoconductor is generally configured to continuously revolve such that any given pixel is repeatedly moved past the diodes at a substantially regular cycle and at a substantially constant rate, and along a substantially fixed path relative to the diodes. Each pixel is capable of being charged to a given electrical potential, independent of the electrical charge of each surrounding pixel.

During operation of the printer, substantially all of the pixels are first charged to a base electrical charge as they move past a charging unit during each revolution of the photoconductor. Then, as the pixels move past a diode, a beam of energy, such as a laser, is either directed at, or not directed at, each of the pixels as dictated by the digital data used to pulse the laser. If the laser is directed at a given pixel, the given pixel can be electrically altered by changing (typically discharging) the base electrical charge to a second electrical charge.

Thus, after passing a laser during operation of the printer, a first portion of the pixels will remain at the base electrical charge because they were not exposed to the laser, while a second portion will have a different charge because of being altered by the laser. The first and second portions of unaltered and altered pixels thus form an image on the photoconductor. One portion of pixels will attract toner, while the other portion will not, depending on various factors such as the electrical potential of the toner. That is, the unaltered pixels will either attract or not attract toner, and vice versa with regard to the altered pixels.

In most electrophotographic printing processes, the altered, or electrically discharged, pixels attract toner onto the photoconductor. In this manner, toner is selectively transferred to the image made up of electrically discharged pixels on the photoconductor. This process is known as discharge area development (DAD). However, in some electrophotographic printing processes toner is attracted to the un-discharged (i.e., charged) pixels on the photoconductor. This latter type of electrophotographic printing is known as charge-area-development (CAD). The present invention is meant to encompass both DAD and CAD printers.

Once the toner has been applied to the photoconductor to form an image, the image is ultimately transferred to finished product medium, such as a sheet of paper. Although the finished product medium typically comprises paper, it can also comprise other materials such as plastic, as in the case of a transparency. Also, finished product medium can comprise individual sheets, such as a typical eight-and-one-half inch by eleven inch sheet of paper, or it can also comprise a long, continuous sheet.

The transfer of toner from the photoconductor to the finished product medium can be direct, or it can be indirect using an intermediate transfer device. That is, in the direct method, the toner is transferred directly from the photoconductor to the finished product medium. In the indirect method, the toner is transferred first to an intermediate transfer device, then transferred from the intermediate transfer device to the finished product medium. The intermediate transfer device typically comprises a revolvable endless belt. During operation of the printer, the intermediate transfer device typically moves by circulating, or revolving, past the photoconductor. The finished product medium, in turn, is caused to pass by the intermediate transfer device.

After the toner is transferred to the finished product medium, it is processed to fix the toner thereto. This last step is normally accomplished by thermally heating the toner to fuse it to the finished product medium, or applying pressure to the toner on the finished product medium. Any residual toner on the photoconductor and/or the intermediate transfer device is then removed by a cleaning station, which can comprise either or both mechanical and electrical means for removing the residual toner.

A variety of methods are known for selectively attracting toner to a photoconductor. Generally, each toner has a known electrical potential affinity. As described above, selected pixels of the photoconductor can be exposed by a laser from a base potential to a given potential associated with the selected toner, and then the toner can be presented to the photoconductor so that the toner is attracted only to the selectively exposed pixels. This latter step is known as developing the photoconductor.

In some processes, after the photoconductor is developed by a first toner, the photoconductor is then recharged to the base potential and subsequently exposed and developed by a second toner. In other processes, the photoconductor is not recharged to the base potential after being exposed and developed by a selected toner. In yet another process, the photoconductor is exposed and developed by a plurality of toners, then recharged, and then exposed and developed by another toner. In certain processes, individual photoconductors are individually developed with a dedicated color, and then the toner is transferred from the various photoconductors to a transfer medium which then transfers the toner to the finished product medium. The selection of the charge-expose-develop process depends on a number of variables, such as the type of toner used and the ultimate quality of the image desired.

Image data for an electrophotographic printer (which will also be known herein as a "printer"), including color laser printers, is digital data which is stored in computer memory. The data is stored in a matrix or "raster" which identifies the location and color of each pixel which comprises an overall image. The raster image data can be obtained by scanning an original analog document and digitizing the image into raster data, or by reading an already digitized image file. The former method is more common to photocopiers, while the latter method is more common to printing computer files using a printer. Accordingly, the invention described below is applicable to either photocopiers or printers.

Recent technology has removed the distinction between photocopiers and printers such that a single printing apparatus can be used either as a copier, a printer for computer files, or a facsimile machine. In any event, the image to be printed onto finished product media is provided to the printer as digital image data. The digital image data is then used to pulse the beam of a laser in the manner described above so that the image can be reproduced by the electrophotographic printing apparatus. Accordingly, the expression "printer" as used herein should not be considered as limited to a device for printing a file from a computer, but should also include any device capable of printing a digitized image in the general manner described herein, regardless of the source of the image.

The image data file is essentially organized into a two dimensional matrix within the raster. The image is digitized into a number of lines. Each line comprises a number of discrete points. Each of the points corresponds to a pixel on the photoconductor. Each point is assigned a binary value relating information pertaining to its color and potentially other attributes, such as density. The matrix of points makes up the resultant digitally stored image. The digital image is stored in computer readable memory as a raster image. That is, the image is cataloged by line, and each line is cataloged by each point in the line. A computer processor reads the raster image data line-by-line, and actuates the laser to selectively expose a given pixel based on the presence or absence of coloration, and the degree of coloration for the pixel.

The method of transferring the digital raster data to the photoconductor via a laser, lasers, or LEDs, is known as the image scanning process, or the scanning process. The scanning process is performed by a scanning portion, or scanning section, of the electrophotographic printer. The process of attracting toner to the photoconductor is known as the developing process. The developing process is accomplished by the developer section of the printer. Image quality is dependent on both of these processes. Image quality is thus dependent on both the scanning section of the printer, which transfers the raster data image to the photoconductor, as well as the developer section of the printer, which manages the transfer of the toner to the photoconductor.

In the case of a typical multi-color laser printer, at least one laser scanner is included and utilized to generate a latent electrostatic image on the photoconductor. Generally, one latent electrostatic image is generated for each color plane to be printed. A "color plane" generally refers to a portion of the output image which comprises only a single color of toner. For example, in a four-color laser printer, the final output image comprises four color planes. This allows for each of four colors to be imaged first onto a photoconductor, then transferred onto an intermediate transfer device, and finally transferred from the intermediate transfer device to the finished product medium.

In a typical scanning process, a laser is scanned from one edge of the photoconductor to the opposite edge while being selectively pulsed in accordance with the image data file. That is, the laser scans across the photoconductor, following a row of pixels. As the laser scans along the row of pixels, it is selectively pulsed a pixel-by-pixel basis. That is, for each pixel in a row, the laser is either directed at the pixel, or not directed at it. The scan of the laser in this manner causes a line of point which make up the digital image to be transferred from the raster onto the photoconductor. As the photoconductor moves past the laser, the laser advances to the next row of pixels, and the next line of points from the digital image is scanned by the laser onto the photoconductor. The image data is thus scanned onto the photoconductor in a pixel-by-pixel and line-by-line basis until the complete image is transferred to the photoconductor.

The side-to-side scanning action of each laser is traditionally accomplished using a dedicated multi-faceted rotating polygonal mirror at which a stationary laser is aimed. The rotation or the mirror causes the reflected laser beam to be scanned across the photoconductor at a unique relative lineal position from a first edge to a second edge of the photoconductor. As the mirror rotates to an edge of the polygon between facets, the reflected laser reaches the edge of the photoconductor. When the laser is reflected off of the next facet as it rotates into position, the laser is essentially reset to the first edge of the photoconductor to begin scanning a new line onto the advancing photoconductor.

Generally, there are two types of color laser printers. One type is the multi-pass printer and the other type is the in-line printer. The multi-pass type of laser printer, also known as the four-pass, is generally provided with a single photoconductor and a single laser/mirror scanner system. The four-pass type is also generally provided with a movable intermediate transfer device, commonly in the form of an endless belt which circulates, or revolves, past the photoconductor. In operation, each of the four color planes (typically black, yellow, cyan, and magenta) which make up an output image is consecutively developed on the photoconductor and completely deposited on the intermediate transfer device. That is, as a first color plane is developed on the photoconductor, it is deposited in its entirety, as toner, on the intermediate transfer device as the device makes a complete first revolution, past the photoconductor.

The intermediate transfer device then begins a second revolution past the photoconductor during which the second color plane is developed on the photoconductor and deposited in its entirety on the intermediate transfer device in registered alignment with the first color plane. This process is repeated in like manner for the third and fourth color planes until all four color planes have been deposited on the intermediate transfer device so as to build-up the completed image thereon. It is important that each succeeding color plane is deposited exactly "on top of" the previous color plane. That is, each succeeding color plane is superimposed, or deposited in registration with, the previous color plane. After the image has been completed with all four color planes on the intermediate transfer device, the image is then transferred to a sheet of finished product medium.

As mentioned above, another type of printer is the in-line type. The in-line type of printer generally has a photoconductor and a laser/mirror scanner system of each color of toner. Thus, a typical in-line printer will include four photoconductors and four laser/mirror scanner systems, wherein each of the laser/mirror scanner systems correspond to one each of the photoconductors. The photoconductors are usually situated "in-line" relative to one another, and proximate to the intermediate transfer device. Each of the photoconductor-laser/scanner combinations is dedicated to producing a given color plane. For example, a particular photoconductor-laser/scanner combination can produce only yellow color planes, while another photoconductor-laser/scanner combination can produce only magenta color planes.

In general, multi-color printers are configured as four-color printers. However, at least three colors of toner are generally provided in order to produce at least the basic hues of the visible color spectrum. These three colors usually include yellow, cyan, and magenta. These three colors are known as "complimentary" colors or "subtractive primary" colors. The complimentary colors are known as such because they each compliment one of the primary colors which are red, blue, and green. That is, yellow compliments blue, cyan compliments red, and magenta compliments green.

The term "compliment" in this context means that light of one of the primary colors added to light of its complimentary color will yield white light. The reason for this is that light having a complimentary color is made up of light of two primary colors. That is, yellow light is made up of green light and red light. Cyan light is made up of green light and blue light. Magenta light is made up of blue light and red light. When light of each of the primary colors is mixed, white light results. Thus, when light of a primary color and light of its compliment are mixed, white light is produced since a primary color and its compliment together always comprise all three primary colors.

One reason for using toners of the complimentary colors in printing processes rather than using toners of the primary colors stems from the "filtering" effect of toners. That is, toner does not produce or transmit light, but only reflects or filters light. For example, when white light is directed at cyan toner, it will act as a filter to filter out red light. That is, cyan toner will only allow blue and green light to pass through it, or be reflected from it. In other words, cyan toner removes or absorbs red light from white light, letting blue and green light pass through, or be reflected as the case may be. Similarly, magenta toner filters out green light and yellow toner filters out blue light. On the other hand, if toner of a primary color is used, it will filter out all other colors except its color. For example, red toner will filter out both blue and green light. Similarly, green toner will filter out both blue and red light, and blue toner will filter out both red and green light.

Thus, if toners or primary colors (red, blue, green) are used to create a printed image, only those three primary colors can be produced in a printed image. This is because toners of primary colors generally cannot be combined to produce other printed colors. That is, if one primary color toner is applied over another primary color toner to produce a printed image, no light will be reflected or allowed to pass through and the printed image will appear black or dark brown. For example, if a blue toner is applied over a red toner, substantially no light will be reflected or allowed to pass through the image since the blue toner will block red light and green light, and the red toner will block blue light and green light. In that case, all three primary color will be blocked and substantially all light will be absorbed. A like result is achieved in combining blue toner with green toner and in combining red toner and green toner. Toners of primary colors will be visible only if each is printed alone. Thus, if only toners of primary colors are used, images comprising only red, green and blue can be produced.

However, if toners of the complimentary colors are used, a different result is achieved. Because complimentary colors block, or absorb, only one primary color rather than two, a combination of two toners of complimentary colors will result in one of the primary colors. For example, if cyan and yellow toner are printed over one another, a green color can be produced. This is because, cyan toner will block only red light, letting green and blue light pass or reflect, while yellow toner will block only blue light, letting red light and green light pass or reflect. Thus, neither the cyan toner nor the yellow toner will block or absorb green light, which will be allowed to reflect or pass through. Similar results can be achieved in combining the other complimentary colors.

Therefore, when toners of the complimentary colors are used, both complimentary and primary colors can be produced because the complimentary colors can be printed alone, or combined to produce primary colors. In addition, varying shades can be produced by using differing proportions of each of the complimentary toner colors. In this manner, toners of the complimentary colors can be combined in printing processes to produce a fuller gamut of colors than if only toners of the primary colors were used. In addition to toners of yellow, cyan, and magenta, a fourth toner, that of black, is also generally included in multi-color printers. Although black is arguably not a "color," it is generally referred to as one of the four colors when used in a typical four-color printer.

Toner, as used in laser printers, is generally in the form of a fine powder. Each color of toner is contained in a dedicated compartment to avoid mixing the different color toners prior to deposition of the toners on the photoconductor. The toner compartments are usually configured as cartridges which are removable from the printer apparatus. The removable nature of the cartridges facilitates resupply of the toner. That is, when the level of toner in a given toner cartridge becomes low, or when the cartridge becomes empty, the cartridge can be removed from the printer and replaced by another like cartridge which contains a supply of the same color toner.

When a low level of a given toner occurs, a result is that the given toner generally is not applied to the photoconductor in an amount in which it was intended to be applied. That is, because of the low level of toner in the toner cartridge, less than the proper amount of toner is applied to the photoconductor. This condition is sometimes referred to as toner "fade" since the appearance on finished product medium, such as white paper, is that of a faded color. The "fading" appearance is generally due to the whiteness of the paper appearing through areas of relatively thinly applied toner. Toner fade which is due to a low toner condition is undesirable because it often results in output images of unacceptable quality.

Prior art printers often have unreliable means of detecting or anticipating a low toner condition. Thus, with regard to prior art printers, a low toner condition can go undetected until an operator or user of the printer discovers toner fade in output images which have been produced by the printer. Because a user or operator of a prior art printer typically does not continually monitor the output images as they are produced by a prior art printer, a low toner condition can go undetected, for example, during large printing jobs. This can result in a considerable number of output images which are unacceptable in quality. This, in turn, can create a large amount of wasted resources because the print job then must be redone.

One attempt at increasing the reliability of low toner detection means in prior art printers has been to include a scanner device through which the output images from the printer are passed. The scanner device digitally scans each output image, and then attempts to match the scanned image with the ideal reference image which corresponds to each output image. If any discrepancies between the scanned image and the ideal reference image are detected by the scanning process, the operator can then be alerted to the possibility of a low toner condition. However, scanner devices are known to be relatively complex, and adding such a scanner operation to the printer operation can tend to add considerable complexity to the printing process. In addition, the scanning and matching procedure, as described above, can tend to slow or limit the speed of output image production.

What is needed, then is a relatively simple and quick method and apparatus to detect a low toner condition in a color printing apparatus.

SUMMARY OF THE INVENTION

The invention includes methods and apparatus for examining toner areas in a color laser printer in order to detect a low toner condition.

In accordance with a first embodiment of the present invention, an apparatus for examining toner areas in order to detect a low toner condition is disclosed. The apparatus has at least one energy detector, each of which can be a densitometer. The apparatus in accordance with the first embodiment of the invention can also have a support surface which can be movable and which can support and move at least one toner area. As the at least one toner area is moved by the support surface past the at least one energy detector, the at least one energy detector can detect electromagnetic energy which is reflected from the at least one toner area. The apparatus in accordance with the first embodiment of the invention can also include at least one energy source which can be configured to produce electromagnetic energy and direct the energy toward the support surface and the toner area. The at least one energy detector can detect a variation in intensity of energy reflected from the at least one toner area. A given variation in intensity can indicate toner fade due to a low toner condition.

In accordance with a second embodiment of the present invention, another apparatus for detecting a low toner condition is disclosed. The apparatus in accordance with the second embodiment of the present invention can also have at least one energy detector, a movable support surface configured to support at least one toner area, and at least one energy source. However, in accordance with the second embodiment of the present invention, each of the at least one energy sources can be configured to selectively produce electromagnetic energy of one of a plurality of given wavelengths within a given range of wavelengths. For example, the at least one energy source, in accordance with the second embodiment of the present invention, can be configured to produce electromagnetic energy of a first wavelength, such as a first color, and energy of a second wavelength, such as a second color, and energy of a third wavelength, such as a third color.

In accordance with a third embodiment of the present invention, yet another apparatus for detecting a low toner condition is disclosed. The apparatus in accordance with the third embodiment of the present invention can include a movable support surface which can support at least one toner area. The apparatus also includes a plurality of energy detectors which can detect intensity of electromagnetic energy which is reflected from a toner area located at substantially any position across the width of the support surface. The apparatus in accordance with the third embodiment of the present invention can also include at least one filter which can be configured to filter electromagnetic energy reflected from the at least one toner area and before the reflected energy reaches the at least one energy detector. The at least one filter can be configured to block electromagnetic energy of certain wavelengths, while allowing electromagnetic energy having other wavelengths to pass through. The at least one filter can include, for example, a color filter which can allow light of substantially a given wavelength to pass through while blocking light of other wavelengths.

In accordance with a fourth embodiment of the present invention, still another apparatus for detecting a low toner condition in a color laser printer is disclosed. In accordance with the fourth embodiment of the present invention, the apparatus can include an energy source which is configured to produce electromagnetic energy and to direct the energy into an energy-transmitting conduit, such as a fiber optic filament. The energy transmitting conduit can be configured to transmit the energy to at least one energy transmission points, from which energy can be directed toward a support surface and toward at least one toner area which can be movably supported on the support surface. The apparatus, in accordance with the fourth embodiment of the present invention comprises a full-width energy detector which can detect intensity of energy reflected from the at least one toner area.

In accordance with a fifth embodiment of the present invention, yet still another apparatus for detecting a low toner condition in a color laser printer is disclosed. The apparatus, in accordance with the fifth embodiment of the present invention, can include a plurality of energy sources, each of which can produce electromagnetic energy of a plurality of given wavelengths. For example, a first energy source can produce energy of a first wavelength, and a second energy source can produce energy of a second wavelength. Each of the energy sources can be configured to direct energy into one each of a plurality of energy-transmitting conduits which can comprise, for example, fiber optic filaments. Each of the energy-transmitting conduits can be configured to transmit energy to each of a plurality of energy transmission points, from which energy can be directed toward at least one toner area which can be supported on a movable support surface. The apparatus, in accordance with the fifth embodiment can further include a plurality of energy collectors, which can comprise, for example, an optical lense. Each energy collector can be configured to collect energy reflected from the at least one toner area and direct the collected energy to one each of a plurality of energy detectors.

In accordance with a sixth embodiment of the present invention, a method of detecting a low toner condition in a color laser printer is disclosed. The method can include detecting intensity of electromagnetic energy which is reflected from a toner area. Detecting a variation in intensity of electromagnetic energy reflected from a toner area can also be included in the method, as can comparing intensity of energy reflected from a toner area to a reference value. The method can also include detecting intensity of electromagnetic energy reflected from a first toner area, detecting intensity of electromagnetic energy reflected from a second toner area, and comparing intensity of electromagnetic energy reflected from the first toner area to intensity of electromagnetic energy reflected from the second toner area.

DETAILED DESCRIPTION OF THE INVENTION

The invention includes methods and apparatus for detecting a low toner condition in a color laser printer. A method in accordance with the present invention can include detecting intensity of electromagnetic energy which is reflected from at least one toner area. The method can also include detecting a variation in the electromagnetic energy reflected from at least one toner area. An apparatus in accordance with the present invention can include at least one energy detector which is configured to detect electromagnetic energy which is reflected from at least one toner area. The apparatus can also include at least one energy source which is configured to produce energy and direct the energy toward at least one toner area.

The apparatus of the present invention is described herein in terms of a "printer" among other terms. By "printer" I mean an imaging device that can comprise an intermediate transfer device and comprises at least one photoconductor which can be positioned relative to the intermediate transfer device such that each of the photoconductors deposits at least one of a plurality of toners on the intermediate transfer device to produce an image thereon. The intermediate transfer device can then move the image comprising toner deposited thereon to a transfer module where it can be transferred to a finished product medium, such as a sheet of paper. The at least one photoconductor can alternatively be configure to deposit toner directly onto finished produce medium without the intervening transfer of the toner otherwise provided by an intermediate transfer device.

One example of a "printer" which is within the scope of the present invention is a color photocopier. Another example is a device known as a computer printer. However, the invention should not be considered as being applicable only to these examples, but is understood to be applicable to all apparatus, and related methods, for producing an image using toner. Methods and apparatus in accordance with the present invention will now be more fully described.

Figure 1:
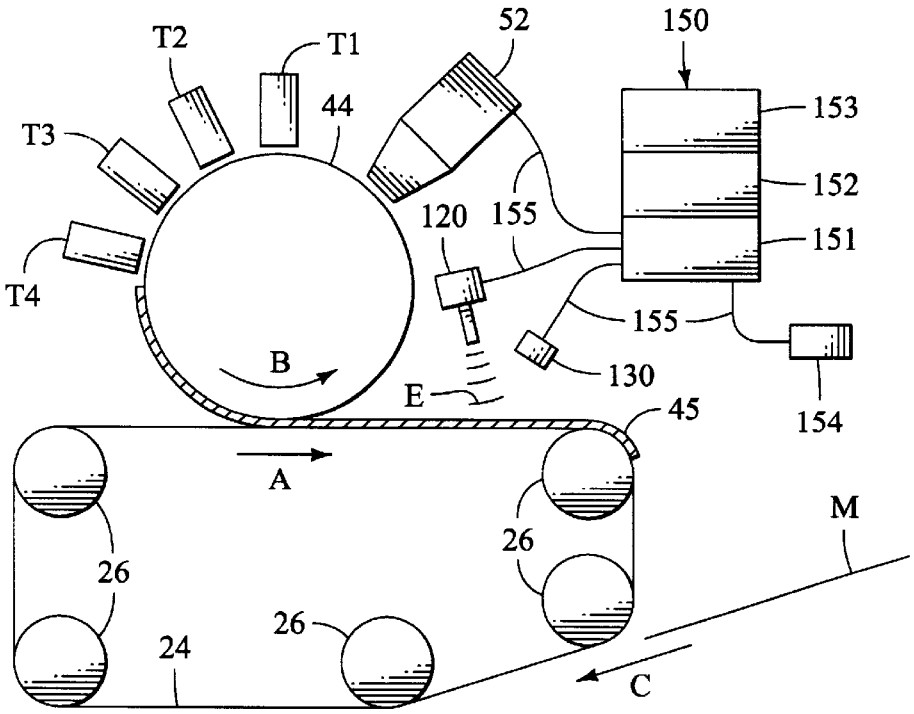
FIG. 1 is a side elevation schematic diagram of an apparatus in accordance with a first embodiment of the present invention.

With reference to FIG. 1, an imaging apparatus 100 in accordance with a first embodiment of the present invention is depicted in a schematic side elevation diagram. As is seen, the apparatus 100 can comprise an intermediate transfer device 24. The intermediate transfer device 24 can be configured as an endless belt supported by a plurality of substantially parallel rollers 26 as shown. The intermediate transfer device 24 can move, or revolve, in the direction "A." The apparatus 100 can also comprise at least one photoconductor 44 which can be configured to rotate in the direction "B."

The apparatus 100 can also comprise a scanning section 52 which can be configured to scan an image onto the photoconductor 44 as described above using a laser (not shown) or the like. The apparatus 100 can include at least one toner cartridge T1 and can alternatively include an additional plurality of toner cartridges T2, T3, T4. The toner cartridges T1, T2, T3, T4 can be configured to deposit toner on the photoconductor 44 as described above to form an image 45.

The apparatus 100 also comprises at least one energy source 120 which can be configured to produce energy "E" and to direct the energy toward the image 45. The apparatus 100 also includes at least one energy detector 130 which can be configured to detect at least a portion of the energy "E" which is reflected through the image 45. Although the energy source 120 and the energy detector 130 are shown as separate components, it is understood that the energy source and energy detector can be combined into a single component. Furthermore, it is understood that, in accordance with any of the embodiments of the present invention, the term "energy detector" can include, but is not limited to, a densitometer. Densitometers are discussed in further detail below.

The apparatus 100 can be configured to transfer the image 45 to finished product medium "M" which can be moved past the intermediate transfer device 24 in the direction "C" as shown. Alternatively, the apparatus 100 can be configured to transfer the image 45 directly from the photoconductor 44 to finished product medium "M," in which case the intermediate transfer device 44 and rollers 26 can be omitted. Also, it is understood that any number and combination of photoconductors 44 and toner cartridges T1, T2, T3, T4 can be employed in accordance with the present invention.

For example, an apparatus which is not shown and which is in accordance with an alternative embodiment of the present invention can comprise a plurality of photoconductors 44, wherein at least one toner cartridge T1, T2, T3, T4 is configured to apply toner to one of each of the plurality of photoconductors. In that case, each photoconductor 44 can be provided with a dedicated scanner similar to the scanner 52. In such a configuration, the energy source 120 and the energy detector 130 are preferably located after the last of the plurality of photoconductors 44, each of which can deposit toner onto the intermediate transfer device 24. Alternatively, a dedicated energy source 120 and a dedicated energy detector 130 can be provided for each of the plurality of photoconductors 44.

Referring to the apparatus 100 which is depicted in FIG. 1, each of the toner cartridges T1, T2, T3, T4 can be configured to deposit a specific color of toner onto the photoconductor 44. For example, a first toner cartridge T1 can be configured to deposit a first toner having a first color. A second toner cartridge T2 can be configured to deposit a second toner having a second color. A third toner cartridge T3 can be configured to deposit a third toner having a third color. Likewise, a fourth toner cartridge T4 can be configured to deposit a fourth toner having a fourth color. The image 45 can comprise any combination of the toners. That is, the image 45 can comprise a single toner, or a plurality of any combination of the toners. The image 45 can be an output image, or can be a calibration patch, or the like. The image 45 also comprises at least one toner area (not shown). By "toner area," I mean an area of an image 45 which comprises at least one toner. The apparatus 100 can be configured to selectively examine at least one toner area for toner fade. That is, the apparatus 100 can be employed to detect toner fade in at least one toner area which makes up an image 45.

The apparatus 100 can also comprise a controller 150 which can be configured to control the operation of the apparatus, including the operation of the scanner section 52, the energy source 120, and the energy detector 130. The apparatus can also include an output device 154 which is more fully described below. The controller 150 can include, for example, a processor 151, a data storage memory 152, and an algorithm 153.

The controller 150 can be in communication with any of the components of the apparatus 100, including for example, the scanner 53, energy source 120, energy detector 130, and output device 154 by way of signal transmitting conduits 155 which can be connected there between. The signal transmitting conduits 155 can include electrically conductive material, such as wire, and can also include fiber optic filaments. Alternatively the controller can also be in communication with any of the components of the apparatus 100 by way of remote "wireless" signal transmission, such as by way of infrared radiation, radio waves, sound waves, microwaves, and the like.

Figure 2:
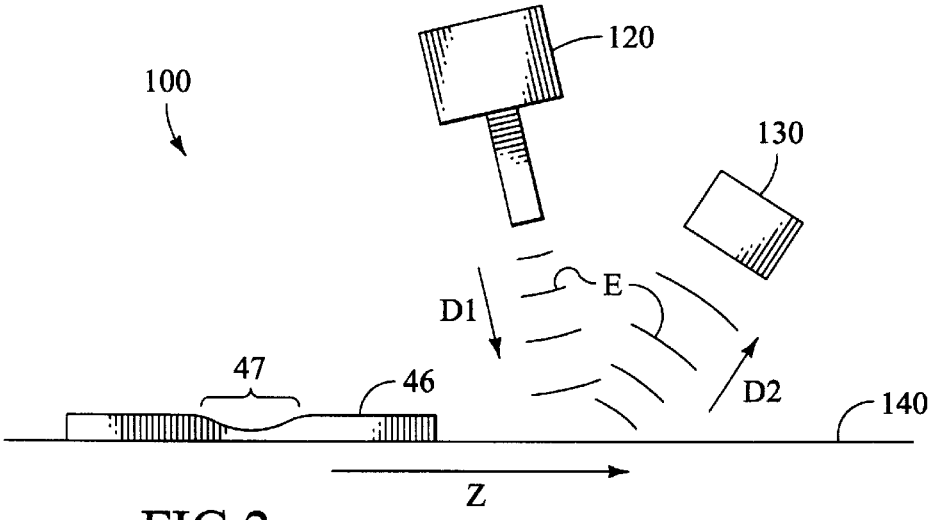
FIG. 2 is a partial side elevation schematic diagram of the apparatus depicted in FIG. 1.

Turning now to FIG. 2, a partial side elevation schematic diagram is shown, which depicts the energy source 120 and energy detector 130 of the apparatus 100. Additionally, the apparatus 100 comprises a support surface 140, on which a toner area 46 is supported. By "support surface" I mean any surface which is configured to support at least one toner area 46. With respect to FIG. 1, the support surface 140 is depicted as being a surface of the intermediate transfer device 24.

However, it is understood that both the energy source 120 and the energy detector 130 can be alternatively positioned in accordance with other embodiments of the present invention which are not shown. That is, the support surface 140, in accordance with any of several possible alternative embodiments of the present invention, can be either a surface of the photoconductor 44, a surface of the intermediate transfer device 24, or the surface of finished product medium "M," or the like.

Moreover, although the support surface 140 is depicted herein as being substantially flat and level, it is understood that the support surface as employed in conjunction with any embodiment of the present invention can be configured to have any profile which will permit the support surface to function in a manner in which it is intended. For example, the support surface 140 can have, in the alternative, a curved profile. The support surface 140 can be configured to move the toner area 46 past the energy source 120 and the energy detector 130 in the direction "Z." Alternatively, the support surface 140 can be configured to move the toner area 46 past the energy source 120 and energy detector 130 in a direction which is opposite of the direction "Z."

Still referring to FIG. 2, the support surface 140 can support at least one toner area 46 which can comprise at least one toner. The toner area 46 can preferably have a "uniform thickness area." By "uniform thickness area" I am referring to a portion of a toner area 46 that, in theory, is intended to be produced entirely with a substantially uniform thickness. However, in the case of a low toner condition, the toner area 46 can have at least one thinned area 47 which can be caused by toner fade due to the low toner condition.

As is seen, the energy source 120 can be configured to produce energy "E" and to cause at least a portion of the energy it produces to be directed at the support surface 140 in the direction "D1" as the support surface moves the toner area 46 past the radiation source in the direction "Z." Preferably, the energy "E" can be in the form of electromagnetic energy. By "electromagnetic energy" I mean energy which is in the form also known as electromagnetic radiation and displays properties of both wave energy and particle beam energy. Electromagnetic energy can include energy which is known as "light." By "light" I mean to include both visible light, such as colored light and white light, and near visible light, such as ultraviolet light and infrared light. Electromagnetic energy can also include other forms of energy such as radio waves, microwaves, X-rays, and the like.

Preferably, the support surface 140 can be configured to reflect at least a portion of the energy "E" which is produced by the energy source 120. That is, preferably, the support surface 140 can be reflective with respect to the energy "E" which is directed at it. For example, if the energy "E" is in the form of visible light, the support surface can be of a light color, such as white, or light grey. Alternatively the support surface 140 can be a polished metal surface or the like. As shown, the energy "E" can be reflected by the support surface 140 in the direction "D2" and toward the energy detector 130.

The energy detector 130 can be configured to detect at least one characteristic of the energy "E" which is directed at it. For example, the energy detector 130 can be configured to detect the wavelength of the energy "E" which is directed at it. Alternatively, the energy detector 130 can be configured to detect the intensity of the energy "E" which is directed at it. Preferably, in the case in which the energy "E" is visible light, the energy detector 130 can be a densitometer. By "densitometer" I mean a device that is configured to detect the relative intensity of visible light that is directed at it. Densitometers are known in the art and need not be discussed in further detail. By "relative intensity" I mean intensity of the energy "E" which is relative to a reference value.

As mentioned above, the toner area 46 can comprise at least one toner and can comprise a plurality of toners. However, preferably, the toner area 46 can comprise only a single given toner. Also, preferably, the energy "E" has properties that can be affected by the given toner which makes up the toner area 46. For example, the energy "E" can be white light. In that case, since white light comprises light of all three primary colors, then the given toner can affect the energy "E" by absorbing or blocking light of at least one of the primary colors which make up the white light of the energy "E."

More specifically, for example, if the toner area 46 comprises only magenta toner, and the energy "E" is white light, then the magenta toner can affect the energy "E" by absorbing or blocking green light. This will result in only blue light and red light being reflected back to the radiation detector 130. Alternatively, the energy "E" can be ultraviolet light which can be at least partially absorbed by the given toner which makes up the toner area. As a further alternative, the energy "E" can be infra-red light.

Figure 3:
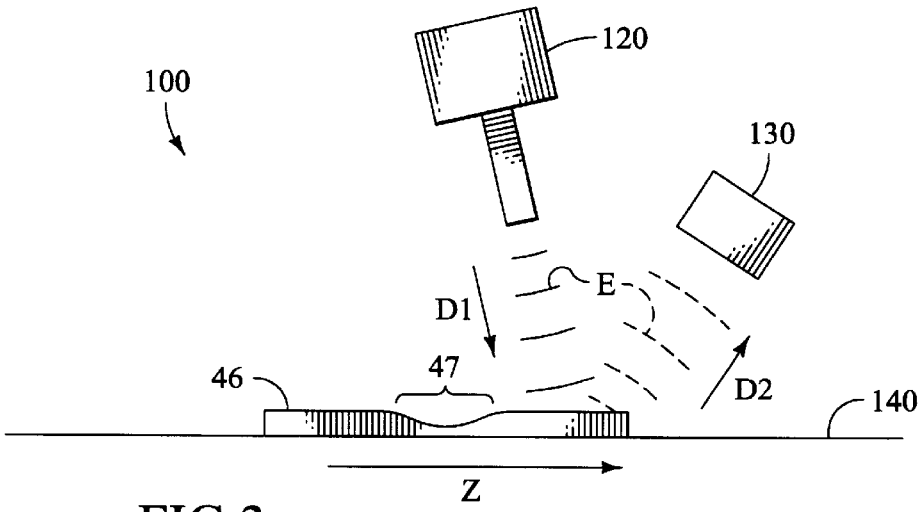
FIG. 3 is another partial side elevation schematic diagram of the apparatus depicted in FIG. 1.

Moving now to FIG. 3, another partial side elevation schematic diagram is shown of the apparatus 100 which is depicted in FIG. 2. As seen, the support surface 140 has moved the toner area 46 in the direction "Z" so that the energy "E" is directed in the direction "D1" and at the toner area. If, for example, the toner area 46 comprises a given toner which effects the energy "E" by absorbing or blocking a portion of the energy, then at least a portion of the energy "E" will not be reflected back to the radiation detector 130.

Thus, the energy detector 130 can detect a given intensity of the energy "E" when the energy is directed at the toner area 46 and reflected to the energy detector as shown. For example, if the energy "E" is white light and the toner area 46 comprises only magenta toner, then light comprising substantially only red light and blue light can be reflected back to the radiation detector 130 in direction D2 when the energy is directed at the toner area. That is, the given toner which makes up the toner area 46 can block or absorb a given portion of at least one of the primary colors of light of which the white light is comprised. It is noted that the energy "E" is shown in FIG. 3 as being directed at a uniform thickness portion of the toner area 46. That is, the energy "E" is shown as not directed at the thinned area 47.

Figure 4:
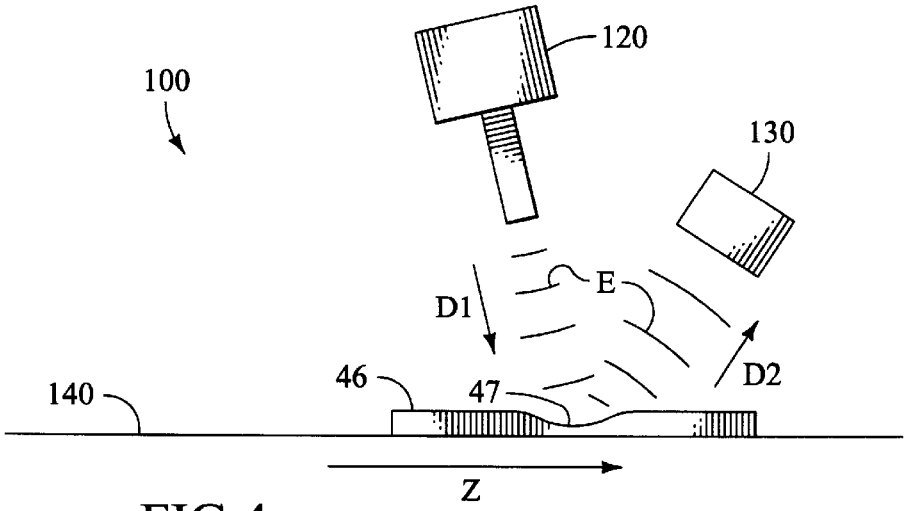
FIG. 4 is yet another partial side elevation schematic diagram of the apparatus depicted in FIG. 1.

Moving to FIG. 4, another partial side elevation schematic diagram is shown of the apparatus 100 which is depicted in FIG. 1. However, in FIG. 4 it is seen that the support surface 140 has moved in the direction "Z" so that the energy "E" is directed in the direction "D1" at the thinned area 47. Because the given toner which makes up the toner area 46 is thinner in the thinned area 47, a greater portion of the energy "E" is reflected in the direction "D2" toward the energy detector.

That is, the thinned area 47 does not block or absorb as much of the energy "E" as does the portion of the toner area 46 which is of a uniform thickness. Thus, when the energy "E" is directed at a toner area 46, an increase in intensity of the energy which is reflected in the direction "D2" toward the energy detector 130 can indicate the presence of a thinned area 47. The processor 150 (shown in FIG. 1) can be configured to detect a variation in the energy "E" directed at the detector 130 as more fully described below.

Figure 5:
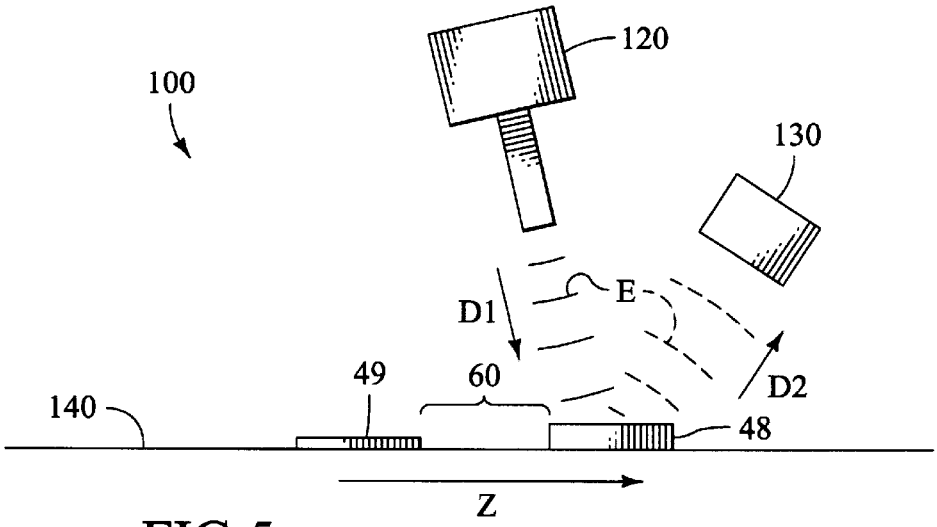
FIG. 5 is still another partial side elevation schematic diagram of the apparatus depicted in FIG. 1.

Moving now to FIG. 5, yet another partial side elevation schematic diagram is shown of the apparatus 100 which is depicted in FIG. 1. However, a different scenario is depicted in FIG. 5 than in FIGS. 2 through 4. As shown in FIG. 5, a first toner area 48 can be supported on the support surface 140. Likewise, a second toner area 49 can be supported on the support surface 140. The first toner area 48 can be separated from the second toner area 49 by a gap 60. The first toner area 48 can have a first average thickness and the second toner area can have a second average thickness which is less than the first average thickness due to toner fade. That is, any substantial difference in thickness between the first toner area 48 and the second toner area 49 can be due substantially to toner fade caused by a low toner condition.

Both the first toner area 48 and the second toner area 49 can be moved past the energy source 120 in the direction "Z." As the first toner area 48 is moved in the direction "Z" past the energy source 120, the energy "E" can be directed in the direction "D1" at the first toner area 48. The energy "E" can be reflected from the first toner 48 area in the direction "D2" toward the energy detector 130. The energy detector 130 can detect an average intensity of the energy "E" reflected in direction "D2" from the first toner area 48.

After the energy detector 130 detects the average intensity of the energy "E" reflected from the first toner area 48, a time interval corresponding to the gap 60 elapses while the first toner area and the second toner area 49 continue to be moved in the direction "Z" by the support surface 140. The support surface 140 can then move the second toner area 49 past the energy source 120 such that the energy "E" is directed at the second toner area. The energy detector 130 can then detect an average intensity of the energy "E" reflected in direction "D2" from the second toner area 49. The average intensity of the energy "E" reflected in direction "D2" from the first toner area can be different than the average intensity of the energy "E" reflected in direction "D2" from the second toner area 49.

More specifically, the difference between the average intensity of the energy "E" reflected in the direction "D2" from the first toner area 48 and the average intensity of the energy "E" reflected in the direction "D2" from the second toner area 49 can be proportional to the difference between the average thickness of the first toner area 48 and the average thickness of the second toner area 49. Thus, if the average thickness of the second toner area 49 is less than the average thickness of the first toner area 48, then the controller 150 (shown in FIG. 1) can detect a significant difference in the level of the average intensity of energy "E" reflected from the first toner area 48 and the level of the average intensity of energy reflected from the second toner area 49, as more fully described below.

Figure 6:
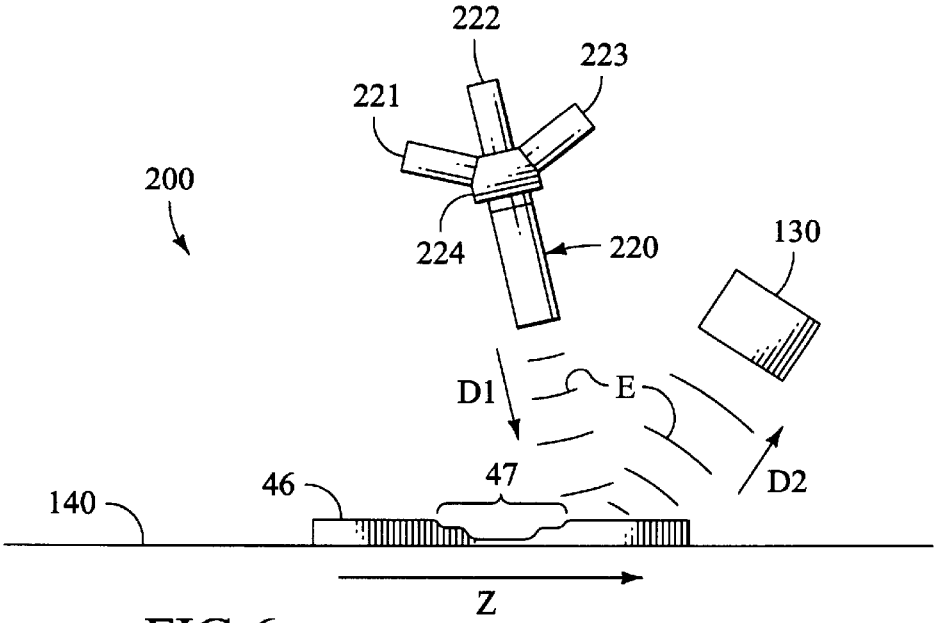
FIG. 6 is a partial side elevation schematic diagram of an apparatus in accordance with a second embodiment of the present invention.

Now moving to FIG. 6, a partial side elevation schematic diagram is shown of an apparatus 200. The apparatus 200 can comprise substantially the same components as does the apparatus 100 which is shown in FIGS. 1 through 5. However, the apparatus 200 can have an energy source 220 which is different than the energy source 120 of the apparatus 100. Referring to FIG. 6, the apparatus 200 can have a support surface 140 which can support at least one toner area 46 which can have a thinned area 47. The support surface 140 can be configured to move the at least one toner area 46 in the direction "Z," although it is understood that the support surface can alternatively be configured to move the at least one toner area in a direction which is substantially opposite of direction "Z."

The energy source 220 can comprise a first light source 221, a second light source 222, a third light source 223, and a lens 224. The first light source 221 can be configured to produce light having a first wavelength. The first light source 221 can also be configured to produce light having the first wavelength at any intensity within a given range of intensities. That is, the first light source 221 can be configured to selectively produce light having the first wavelength at an intensity within a given intensity range.

Similarly, the second light source 222 can be configured to produce light having a second wavelength, and can also be configured to selectively produce light having the second wavelength at any intensity within a given intensity range. Likewise, the third light source 223 can be configured to produce light having a third wavelength, and can also be configured to selectively produce light having the third wavelength at any intensity within a given intensity range.

Preferably, each of the first, second, and third light sources 221, 222, 223 can be configured to produce light having one of the three primary colors of red, green, and blue. That is, for example, the first light source 221 can be configured to produce red light, the second light source 222 can be configured to produce green light, and the third light source 223 can be configured to produce blue light.

Each of the first, second, and third light sources 221, 222, 223 can be configured to direct light into the lens device 224 which can redirect light produced by each of the light sources substantially in the direction "D1" and toward the support surface 140. The lens device 224 can be configured to mix light of two or more of the light sources 221, 222, 223. Thus, the energy source 220 can be configured to produce light of varying color and intensity, including white light, by selectively causing one or more of the first, second, and third light sources 221, 222, 223 to produce their respective colors of light at selected intensities.

The support surface 140 can move the toner area 46 in the direction "Z" so that the energy "E" which is produced by the energy source 220 is directed at the toner area as shown in FIG. 6. Preferably, the energy source 220 can produce energy "E" which is in the form of light which, when directed at the toner area 46 but not at the thinned area 47, can be substantially absorbed or blocked by the toner area. For example, if the toner area 46 comprises only yellow toner, then the energy source 220 can produce energy "E" which is substantially blue light, since yellow toner substantially blocks or absorbs blue light.

The energy source 220 can cause the energy "E" in the form of blue light to be directed in the direction "D1" and at the toner area 46. The energy source 220 can also be configured to produce the energy "E" in the form of blue light at a selected intensity such that substantially all of the blue light is blocked or absorbed by the toner area 46 which comprises yellow toner when the blue light is directed at the toner area, but not at the thinned area 47. Thus, the energy "E" in the form of light can be substantially blocked or absorbed by the toner area 46 so that substantially no light is reflected toward the energy detector 130 and in the direction "D2." The energy detector 130, then, can detect substantially no energy "E" when the energy is directed from the energy source 220 toward the uniform area of the toner area 46.

The support surface 140 can further move the toner area 46 in direction "Z" so that the energy "E" in the form of substantially blue light is directed toward the thinned area 47 and in the direction "D1." The thinned area 47 can reflect at least a portion of the energy "E" which is in the form of blue light in the even that the thinned area cannot absorb or block all of the blue light. Thus, when the energy "E" is directed at the thinned area 47, at least a portion of the energy can be reflected in the direction "D2" toward the energy detector 130. The energy detector 130 can detect the level of energy "E" which is reflected in the direction "D2" from the thinned area 47 and can then relay this level of energy, in the form of a signal, to the controller 150 (shown in FIG. 1) which can then detect a variation in the level of intensity of the energy which is reflected from the toner area 46 in the direction "D2" in a manner which is described more fully below.

Figure 7:
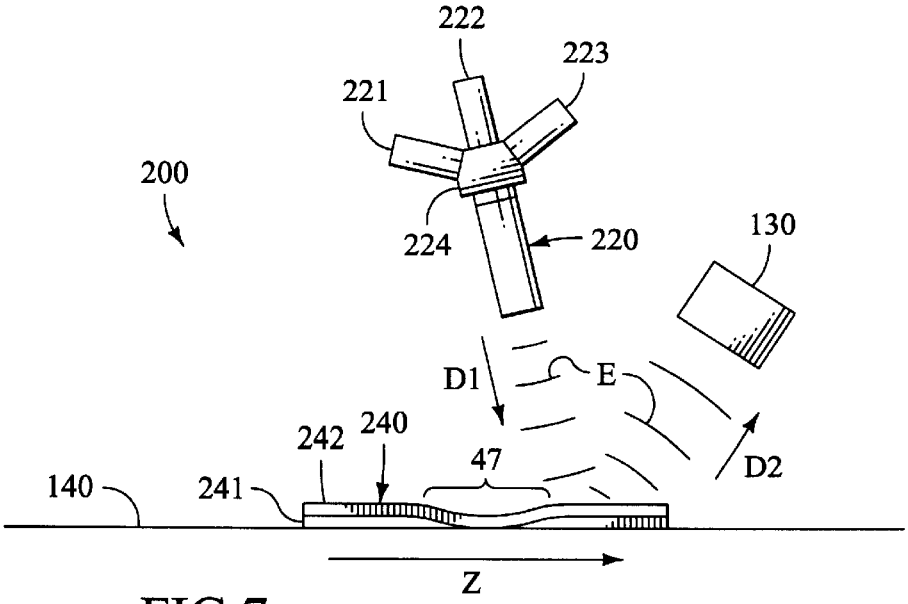
FIG. 7 is another partial side elevation schematic diagram of an apparatus in accordance with the second embodiment of the present invention.

Now moving to FIG. 7, the apparatus 200 can be utilized to detect a thinned area 47 which is due to toner fade, and which is present in a toner area 240 which comprises at least two layers of toner. For example, the toner area 240 can comprise a first toner layer 241 of a first color, such as cyan, and a second toner layer 242 of a second color such as yellow. Alternatively, either the first or second layer can be a third color, such as magenta.

The thinned area 47 is present in the first toner layer 241 and can be covered by the second toner layer 242. It is understood that this discussion can apply as well to an alternative scenario which is not shown and in which the thinned area 47 is present in the upper layer, or first toner layer 241 rather than in the low layer, or second toner layer 242. The support surface 140 can be configured to move the toner area 240 in the direction "Z" past the energy source 220. As the toner area 240 is moved in the direction "Z" by the support surface 140, the energy source 220 can produce energy "E" and direct the energy toward onto the toner area 240. The energy "E" can be configured to have a property or characteristic that can be effected by one of the toner layers 241, 242 which is to be examined for toner fade.

For example, the first toner layer 241 can be chosen to be examined for toner fade. Therefore, the energy "E" which is produced by the energy source 220 can be configured to have a property or characteristic which is effected by the first toner layer 241. More specifically, if the first toner layer 241 is cyan toner, then the energy "E" can be configured to be substantially red light. That is, when a given toner is chosen to be examined, the energy source can produce light having a color of which the given toner is a complementary color. The second toner layer 242 can be either yellow toner or magenta toner. In either case, the energy "E" produced by the energy source 220 and directed at the toner area 240, but not at the thinned area 47, can be substantially absorbed or blocked by the first toner layer 241 which is cyan toner. In that case, the energy detector 130 can detect substantially no energy "E" which is reflected in the direction "D2."

However, the support surface 140 can continue to move the toner area 240 in the direction "Z" so that the energy "E" in the form of substantially red light is directed at the thinned area 47. Because the thinned area 47 comprises relatively little cyan toner, at least a portion of the energy "E" in the form of red light can be reflected from the thinned area in the direction "D2" and toward the energy detector 130. It is noted that the second toner layer 242, which can be either magenta toner or yellow toner, can allow the energy "E" in the form of red light to be reflected from the thinned area 47 because neither magenta nor yellow toner substantially blocks or absorbs red light. Thus, the controller 150 (shown in FIG. 1) can detect an increase in the intensity of energy "E" which is reflected from the toner area 240 when the energy is reflected from the thinned area 47 in a manner which is more fully described below.

Figure 8:
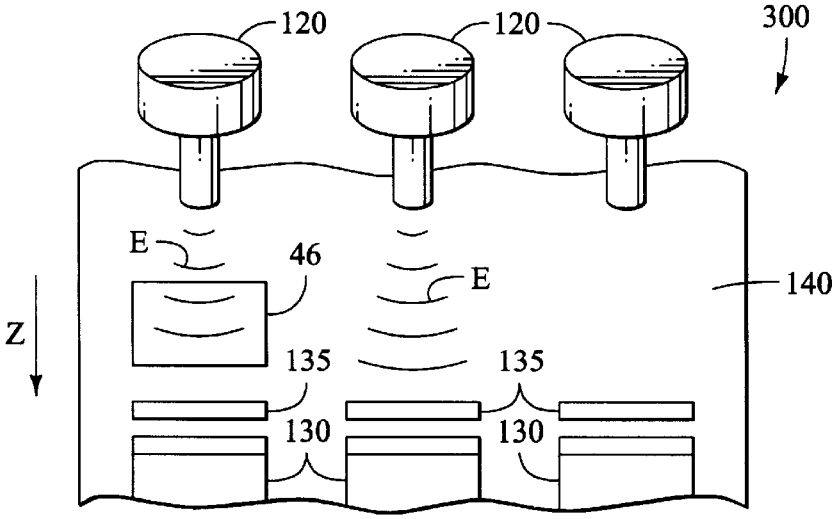
FIG. 8 is a partial top schematic diagram of an apparatus in accordance with a third embodiment of the present invention.

Turning now to FIG. 8, a partial top schematic view is shown of an apparatus 300 in accordance with a third embodiment of the present invention. The apparatus 300 can be configured in a manner similar to the apparatus 100 which is depicted in FIG. 1. However, the apparatus 300 shown in FIG. 8 can have a plurality of energy sources 120. Each of the plurality of energy sources 120 can be configured to produce and direct energy "E" toward the support surface 140. The support surface 140 can, in turn, be configured to support at least one toner area 46, and can be further configured to move the at least one toner area 46 in the direction "Z."

The apparatus 300 can further comprise a plurality of energy detectors 130. Each of the energy detectors 130 can be configured to detect intensity of the energy "E" produced by at least one of the energy sources 120. The energy sources 120 and the energy detectors 130 can be positioned relative to the support surface 140 so that substantially any toner area 46 can be examined for toner fade in accordance with the manner discussed for FIGS. 1 through 5 above, regardless of the position of the toner area relative to the support surface.

The apparatus 300 can also comprise at least one filter 135. Each filter 135 can be positioned relative to one of the plurality of energy detectors 130 so that the energy "E" must pass through the filter 135 before being detected by the energy detector. The at least one filter can be configured to block energy of given wavelengths while allowing energy of other specific wavelengths to pass through. For example, the at least one filter 135 can be a color filter in the case where the energy "E" is light. Color filters are known in the art and can be configured to block light of given wavelengths while allowing light of specific wavelengths to pass through.

Figure 9:
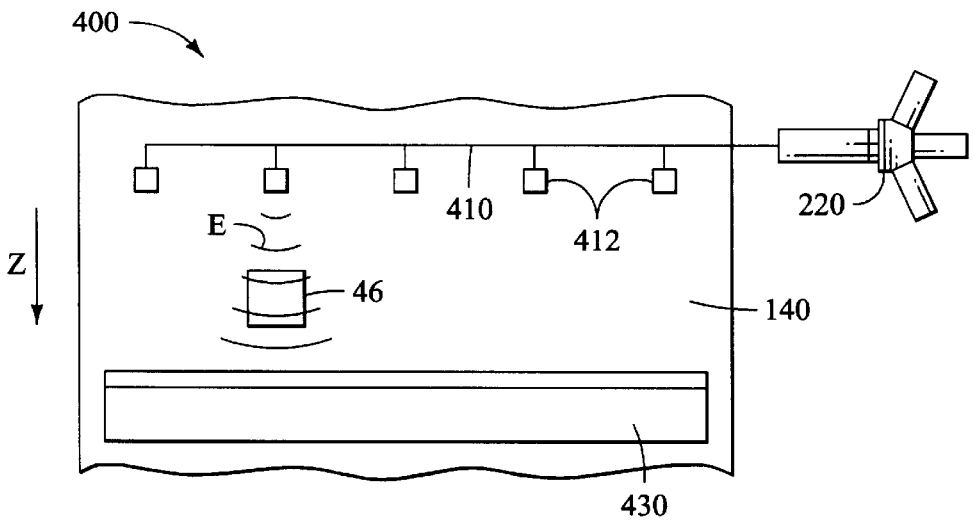
FIG. 9 is a partial top schematic diagram of an apparatus in accordance with a fourth embodiment of the present invention.

Now referring to FIG. 9, a partial top schematic view is shown of an apparatus 400 in accordance with a fourth embodiment of the present invention. The apparatus 400 can also be configured in a manner generally similar to that for the apparatus 100 discussed above and depicted in FIG. 1. However, the apparatus 400 can comprise at least one energy source 220. The energy source 220 has been generally described in regard to the apparatus 200 for FIGS. 6 and 7 above. The at least one energy source 220 shown in FIG. 9 can be configured to produce energy "E." Preferably, the energy source 220 can be configured to produce energy "E" in the form of visible light and more preferably can be configured to produce light of each of the three primary colors of red, green, and blue. That is, the energy source 220 can be configured to selectively produce light of any of the three primary colors of red, green, and blue.

The energy source 220 can be configured to direct the energy "E" into an energy-transmitting conduit 410 which, if the energy "E" is in the form of light, can preferably comprise at least one fiber-optic filament. The distribution conduit 410 can be configured to distribute the energy "E" to a plurality of energy transmission points 412. Each of the transmission points 412 can be configured to direct at least a portion of the energy "E" produced by the energy source 220 toward a support surface 140. Furthermore, each of the transmission points 412 can be configured to selectively direct at least a portion of the energy "E" toward the support surface 140. To selectively direct at least a portion of the energy "E" toward the support surface 140, each of the transmission points 412 can comprise a gate (not shown), such as an optical gate or the like. By "gate" I mean a device which is configured to selectively either block or allow the transmission of energy "E."

By directing at least a portion of the energy "E" toward the support surface 140, each of the transmission points 412 can cause at least a portion of the energy "E" to be directed onto at least one toner area 46. The support surface 140 can be configured to move in the direction "Z." The support surface 140 can also be configured to move at least one toner area 46 in the direction "Z." The apparatus 400 can further comprise a full-width energy detector 430. By "full-width energy detector" I mean an energy detector 430 that is configured to detect energy "E" which is reflected from substantially any point along a line of reference (not shown) which lies on at least one toner area 46, 48, 49, 240 and which is defined as being substantially coplanar to the support surface 140 and substantially transverse to the direction "Z."

Figure 10:
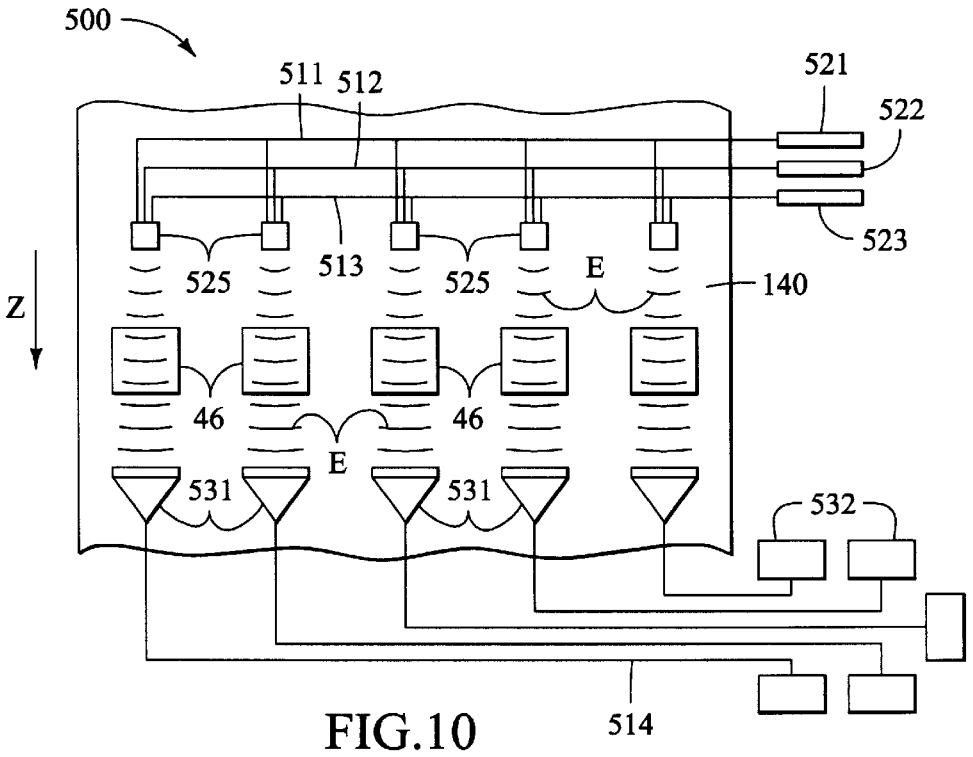
FIG. 10 is a partial top schematic diagram of an apparatus in accordance with a fifth embodiment of the present invention.

Now moving to FIG. 10, a partial top schematic view is shown of an apparatus 500 in accordance with a fifth embodiment of the present invention. The apparatus 500 can be configured in a manner similar to that of the apparatus described for FIG. 1 above. However, the apparatus 500 can comprise a plurality of energy sources 521, 522, 523. Preferably, each of the energy sources 521, 522, 523 can be configured to produce energy "E" in the form of light, wherein each of the energy sources produces light of a different wavelength.

For example, a first energy source 521 can produce energy "E" having a first wavelength. A second energy source 522 can produce energy "E" having a second wavelength. A third energy source 523 can produce energy "E" having a third wavelength. More preferably, each of the energy sources can produce light of one each of the three primary colors of red, green, and blue. For example, the first energy source 521 can be configured to produce energy in the form of red light. The second energy source 522 can be configured to produce energy in the form of green light. The third energy source 523 can be configured to produce energy in the form of blue light.

Each of the plurality of energy sources 521, 522, 523 can be configured to direct its respective energy "E" into one of a plurality of dedicated energy-transmitting conduits 511, 512, 513. For example, the first energy source 521 can direct energy into a first energy-transmitting conduit 511. The second energy source 522 can direct energy into a second energy-transmitting conduit 512. Likewise, the third energy source 523 can direct energy into a third energy-transmitting conduit 513. Each of the plurality of energy-transmitting conduits 511, 512, 513 can be configured to distribute energy "E" of each wavelength produced to each of a plurality of distribution points 525. Each of the distribution points can be configured to direct at least a portion of the energy "E" produced by the energy sources 521, 522, 523 toward a support surface 140.

The energy "E" can preferably be selectively directed from each of the transmission points 525 toward a support surface 140, wherein each of the transmission points comprises at least one gate (not shown), such as an optical gate or the like. The support surface 140 can be configured to move in the direction "Z" and can further be configured to support at least one toner area 46. Energy "E" can be directed at the at least one toner area 46 as the at least one toner area is supported on, and moved by, the support surface 140.

The apparatus 500 can also comprise a plurality of energy collectors 531 which can be configured to collect energy "E" which is reflected from the at least one toner area 46. Each of the energy collectors 531 can be configured to direct energy "E" into one of a plurality of fourth energy-transmitting conduits 514. Each of the plurality of energy-transmitting conduits 514 can be configured to direct energy "E" into one of a plurality of energy detectors 532. The energy detectors can be configured to operate in a manner similar to the energy detector 130 described above for FIGS. 1 through 7.

The following discussion is intended to describe an exemplary operational scheme in which the controller 150 (shown in FIG. 1) determines whether a low toner condition exists. It is understood that the discussion of the operation of the controller 150 and related components is illustrative of but one of many possible operational schemes and is not intended to limit the present invention to any particular operational scheme. It is further understood that the illustrative discussion of the operational scheme is meant to be generally applicable to any embodiment of the present invention, including those which are described herein. The illustrative operational scheme of the present invention shall now be described.

Once a level of the energy "E" is reflected from a toner area 46, 48, 49, 240 and is "read," or detected, by an energy detector 130, 430, 532 of any of the apparatus described above, the detector can generate a corresponding signal which is transmitted to the controller 150 via the corresponding signal transmitting conduit 155. The transmitted signal is representative of the level of energy reflected from the toner area 46, 48, 49, 240 and read by the energy detector 130, 430, 532.

In addition, the transmitted signal can relay other characteristics of the energy reflected from the toner area 46, 48, 49, 240 such as frequency. Preferably, when the transmitted signal is received by the controller 150, it is stored in the data storage memory 152. Since the transmitted signal can be in analog form, it can be preferable to first convert the signal to a digital form using an analog-to-digital converter (not shown), which can be located within the detector 130, 430, 532 or within the controller 150.

After the transmitted signal is received and stored in the controller 150, the controller can activate the algorithm 153 which can use the received signal to determine if a low toner condition exists. In one possible configuration of the algorithm 153, the processor 151 accesses the received signal from the readable memory, or receives it directly from the detector 130, 430, 532, and compares it to a stored reference value.

The stored reference value can be configured to be dependent upon the ideal (i.e. theoretical) color and thickness, among other characteristics, of the toner area 46, 48, 49, 240. Since the output image can originate within the controller 150, the intended color and thickness of the toner area 46, 48, 49, 240 is known by the processor, or can be accessed from the data storage memory which can have the characteristics of the toner area stored there within.

In any case, if the transmitted signal value is different from the reference value by a pre-determined amount, then a low toner condition can be said to exist. In order to reduce the effects of random variation in toner density, the comparison of the transmitted signal with the reference value can be made a number of times and then averaged to determine if the overall average of the transmitted signal value is different from the reference value beyond the pre-determined amount. Likewise, a number of transmitted signals can be received from the detector 130, 430, 532 and averaged before the comparison with the reference value is made.

If the controller 150 determines that a low toner condition exits based on the comparison with the reference value, then it can notify the output device 154 which can be configured to take corrective measures, including the notification of the operator of the apparatus of the low toner condition. The controller 150 can also designate the particular toner color which has the low toner condition. Furthermore, the controller 150 can be provided with a range of reference values such that, when a first reference value is reached by the transmitted signal value, an estimate of the remaining toner life is made, and when a second reference value is reached, a revised (lower) estimate of the remaining toner life is made. These estimates of the remaining toner life can then be made to the operator by way of the output device 154 along with a notification of the low toner condition.

In a second possible configuration of the algorithm 153, the transmitted signal level is received by the controller 150 from the energy detector 130, 430, 532 and is then be stored in the data storage memory 152. Subsequent transmitted signal values which are received from the energy detector 130, 430, 532 are then compared to previous transmitted signal values which are stored in the storage memory 152. If a subsequent transmitted signal value is determined to vary from a subsequent transmitted signal value by more than a pre-determined amount, then a low toner condition can be said to exits.

Many variations of the algorithm 153 are possible. For example, in the second possible configuration of the algorithm 153 described above, the following modification can be made. As long as a low toner condition is not found to exist based on the comparisons of previous transmitted signal values with subsequent values, then the previous transmitted signal values an all be averaged together to form an average previous transmitted signal value. The subsequent transmitted signal values can then be compared with the average previous transmitted signal value to determine if the subsequent transmitted signal value varies from the average value by more than a pre-determined amount.

The energy detector of the present invention can continuously "read" a succession of toner areas to the extent that the toner areas are available to be read by the detector. In other words, the detector can only read those toner areas which are in a position relative to the detector such that energy can be reflected from the toner area and toward the detector. Also, preferably, the toner area is substantially of a uniform thickness and of at least one layer of a single toner. Thus, although the detector can "read" toner areas which make up portions of output images, the toner areas preferably have certain qualities which enable the readings taken by the detector to provide useful data. That is, generally, only a portion of the output images produced by a printer will contain toner areas which can provide useful data and thus will be "read" by the detector.

Figure 11:
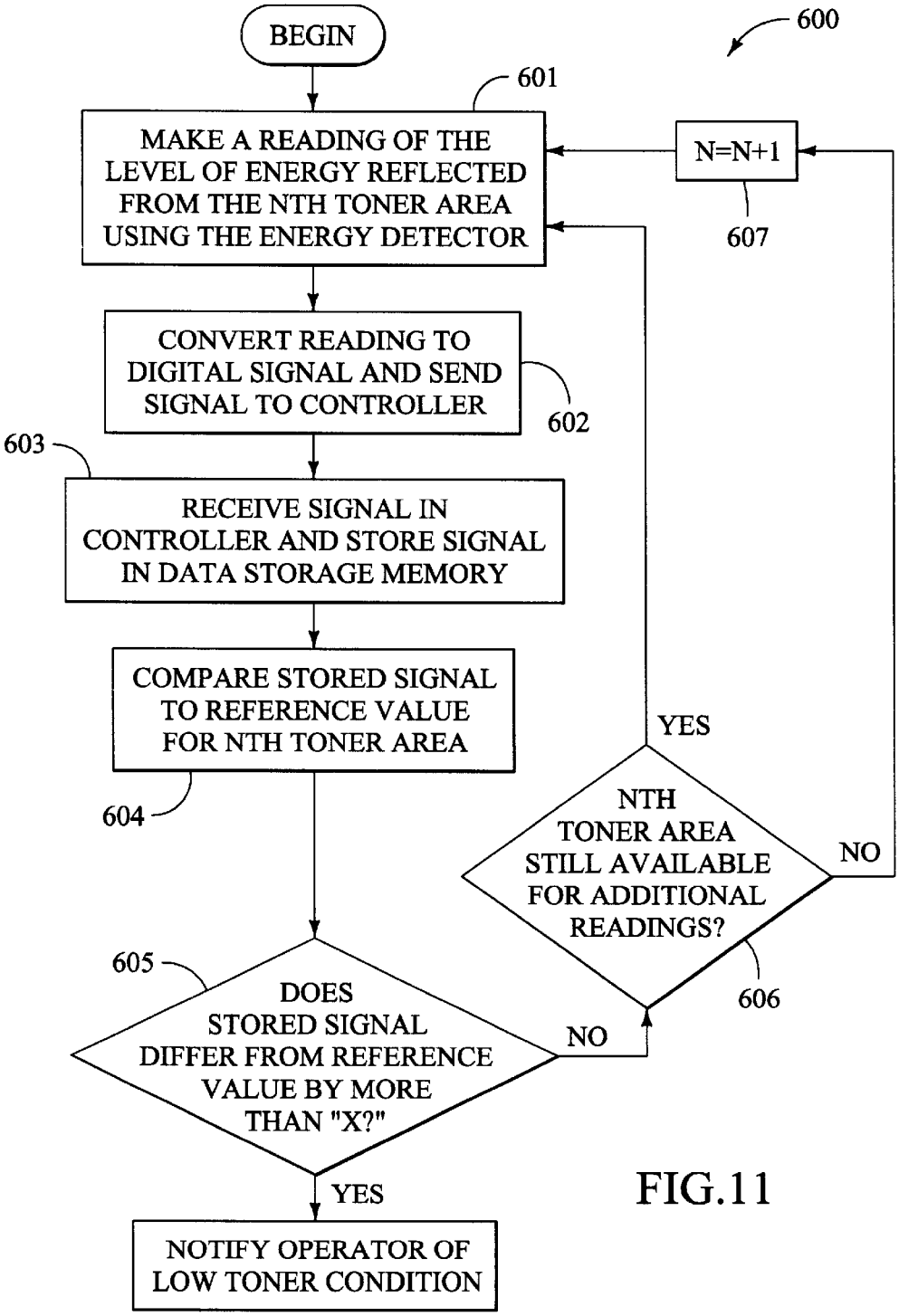
FIG. 11 is a flow diagram of a method in accordance with the present invention.

By way of example, a flowchart 600 is depicted in FIG. 11 and illustrates one possible algorithm for determining if a low toner condition exists. It is understood that the algorithm 600 can be used for any of the apparatus described above. Beginning with step 601, an initial reading is taken of the energy which is reflected from an Nth toner area (where N=1) and detected by the energy detector. In step 602, the reading is converted from an analog reading to a digital signal, and the signal is sent to the controller. Progressing to step 603, the signal is received by the controller and stored in the data storage memory in the form of a digital value. In accordance with step 604, the stored signal is compared to a reference value which is associated with the Nth (first) toner area.

In step 605 the algorithm 600 queries whether the stored signal differs from the reference value by more than a predetermined value "X." If the answer to the query in step 605 is yes, then the algorithm 600 notifies the operator of a low toner condition indicated by the variance in readings which is more than "X." If the answer to the query in step 605 is no, then the algorithm progresses to step 606, which queries whether the Nth (first) toner area is still available for additional readings to be made. If the answer to the query in step 606 is yes, then the algorithm returns to step 601 where the above process is repeated for the Nth (first) toner area. That is, an additional reading is made and then compared to the reference value. This process is repeated as required until the answer to the query in step 606 is no, whereupon the algorithm progresses to step 607.

Step 607 is a counter which increases N by an increment of one (1). That is, in accordance with step 607, the algorithm 600 moves to the next (or second) toner area where the above process is repeated. That is, a reading of the reflected energy from the second toner area is made in accordance with step 601. The algorithm progresses a second time through the remaining steps in the algorithm 600 as described above wherein N now refers to the second toner area. The algorithm 600 continues in the manner described above, with N increasing incrementally by a value of one (1).

In accordance with a sixth embodiment of the present invention, a method of detecting a low toner condition in a printer having a plurality of toner cartridges is provided. The method includes the step of detecting relative intensity of electromagnetic energy reflected by a toner support surface, and detecting intensity of electromagnetic energy reflected from a toner area. The intensity of electromagnetic energy reflected from the toner area is compared to a reference value to determine if a significant variation exists between them. The existence of such a significant variation between the reference value and the intensity of the electromagnetic energy reflected from the toner area can indicate a low toner condition.

In yet another embodiment of the present invention, a method includes detecting the intensity of electromagnetic energy reflected from a first toner area, detecting electromagnetic energy reflected from a second toner area, and then comparing the intensities of the energy reflected from the first and second toner areas to each other. If the comparison yields a at least a minimum pre-determined variation between the intensities of the first and second toner areas, then a low toner condition is indicated. The method can include detecting a variation between the average intensity of electromagnetic energy reflected from the first toner area and the average intensity of electromagnetic energy reflected from the second toner area. Likewise, if the variation is beyond a minimum predetermined value, then a low toner condition is evident.

The method can further include producing electromagnetic energy and directing the electromagnetic energy toward a toner area. This step can include producing electromagnetic energy in the form of light and can also include selectively producing light which has a given wavelength. The selectively produced light can include light comprising at least one of the three primary colors of red, green, and blue. The color of the light can be made to be dependent upon the color of the toner area to be examined for toner fade.

For example, producing light having a color which is a complementary color to the color of the toner area to be examined is one such step. More specifically, green light can be produced and directed onto a magenta toner area which is to be examined for toner fade. Likewise, substantially red light can be produced and directed onto a cyan toner area which is to be examined for toner fade. Similarly, substantially blue light can be produced and directed onto a yellow toner area which is to be examined for toner fade as well.

The step of examining a toner area for toner fade, wherein the toner area comprises two toner layers, each of different toners, can also be performed in accordance with a the present invention. This can be accomplished by first selecting one of the toner layers, which make up the toner area, to be examined for toner fade. Then, light of a primary color and a color of which the toner layer to be examined is a complementary color can be directed at the toner area.

For example, an examination of a selected toner layer which is magenta can be accomplished by directing substantially green light onto the toner area. Likewise, substantially red light can be directed onto a toner area comprising two toner layers when the toner layer to be examined is cyan toner. Similarly, substantially blue light can be directed onto a toner area comprising two toner layers when the toner layer to be examined is yellow toner.

A method in accordance with the present invention can also include producing electromagnetic energy and directing it into an energy-transmitting conduit. The electromagnetic energy can then be transmitted by way of the conduit to at least one of a plurality of energy distribution points. At least a portion of the electromagnetic energy can be directed from at least one of the plurality of distribution points toward at least one toner area. A first portion of the electromagnetic energy can be produced with a first wavelength and can be directed into a first energy-transmitting conduit. Likewise, a second portion of the electromagnetic energy can be produced with a second wavelength and can be directed into a second energy-transmitting conduit. Similarly, a third portion of the electromagnetic energy having a third wavelength can be directed into a third energy-transmitting conduit.

A method in accordance with the present invention can further include transmitting each of the energies having the first, second, and third wavelengths to one each of a plurality of distribution points by way of the respective first, second, and third energy-transmitting conduits. At least one of the energies from at least one of the distribution points can be directed toward at least one toner area. The energy which is reflected from the at least one toner area can be collected by one of a plurality of energy collectors and then directed into one of a plurality of fourth energy-transmitting conduits. The energy thus collected can be transmitted by way of at least one of the plurality of fourth energy-transmitting conduits to at least one energy detector which can convert the level of energy detected into a signal which can then be sent to a controller.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for detecting toner fade in an electrophotographic imaging device, the apparatus comprising:

a support surface configured to movably support at least one toner area, wherein the support surface is configured to substantially reflect electromagnetic energy;

at least two energy sources, each source configured to produce electromagnetic energy within a respective associated range of wavelengths, and to direct at least a portion of the electromagnetic energy toward the at least one toner area; and, at least one energy detector configured to detect relative intensity of electromagnetic energy reflected by the at least one toner area.

2. The apparatus of claim 1, and wherein the at least one energy detector is a full-width energy detector.

3. The apparatus of claim 1, and further comprising an energy-transmitting conduit comprising at least one fibre-optic filament, and wherein the at least one energy source is configured to direct the light into the at least one fibre-optic filament.

4. The apparatus of claim 1, and wherein each of the energy sources is configured to produce an associated color of light selected from the group consisting of red, green, and blue.

5. A method of detecting toner fade in an electrophotographic imaging device, the method comprising, looking for relative variations in intensity of light reflected from a toner area, wherein:

the electromagnetic energy is substantially light of a primary color;

the toner area comprises a first toner layer having a first color and a second toner layer having a second color; and, the first color is substantially a complement of the primary color.

6. A method of detecting toner fade in an electrophotographic imaging device, the method comprising:

providing a support surface;

supporting a first toner area on the support surface;

supporting a second toner area on the support surface;

producing light with an energy source;

directing the light at the support surface;

moving the first and second toner areas past the light in succession;

detecting intensity of light reflected from the first toner area;

detecting intensity of light reflected from the second toner area; and, comparing intensity of light reflected from the first toner area to intensity of light reflected from the second toner area to determine whether a difference in the intensities is present which is indicative of a low toner condition.

7. The method of claim 6, and wherein:

the first toner area comprises a fist toner layer of a first color and a second toner layer of a second color;

the second toner area comprises a first toner layer of the first color and a second toner layer of the second color;

the light produced by the energy source is substantially a primary color; and, the first color is a complement of the color of the light.

8. The method of claim 6, and wherein:

the first toner area comprises a first toner layer of a first color and a second toner layer of a second color;

the second toner area comprises a first toner layer of the first color and a second toner layer of a third color;

the light produced by the energy source is substantially a primary color; and, the first color is a complement of the color of the light.

9. An apparatus for detecting toner fade in an electrophotographic imaging device, the apparatus comprising:

a support surface configured to movably support thereon a toner area, wherein the surface is configured to be substantially light-reflective with respect to ultraviolet light;

at least one energy source configured to produce ultraviolet light, wherein the at least one energy source is further configured to direct at least a portion of the ultraviolet light toward the toner area;

at least one energy detector configured to detect relative intensity of ultraviolet light reflected from the toner area; and, a controller in communication with the at least one energy detector and configured to determine whether a low toner condition exists based on variations in the ultraviolet light reflected from the toner area.

10. The apparatus of claim 9, and wherein the support surface is substantially white.

11. A method of detecting toner fade of a given toner in an electrophotographic imaging device, the method comprising:

providing a support surface on which a toner area is movably supportable;

depositing a toner area comprising toner of a given subtractive primary color on the support surface;

directing light onto the toner area;

moving the toner area relative to the light; and, detecting relative intensity of light which has substantially a predetermined wavelength, and which is reflected from the toner area, wherein the predetermined wavelength corresponds to a primary color of which the given subtractive primary color is a complement.

12. The method of claim 11, and further comprising:

looking for variation in the intensity, wherein any detected variation in intensity of the light is a function of the movement of the toner area relative to the light;

comparing detected variation in intensity to a set of criteria; and, indicating a low-toner condition in response to comparing the detected variation in intensity to the set of criteria.

13. The method of claim 11, and wherein:

the primary color is substantially red in the event that the subtractive primary color is cyan;

the primary color is substantially green in the event that the subtractive primary color is magenta; and, the primary color is substantially blue in the event that the subtractive primary color is yellow.

14. A method of detecting toner fade of a given toner in an electrophotographic imaging device, the method comprising:

providing an energy source configured to produce light having a predetermined wavelength;

providing a support surface on which a toner area is movably supportable, and which is substantially reflective with respect to the light produced by the energy source;

depositing a toner area on the support surface, wherein the toner has a given color;

producing light having the predetermined wavelength, wherein the given color is substantially non-reflective with respect to the light;

directing at least a portion of the light toward the toner area; and, looking for light reflected from the toner area, wherein the light is substantially ultraviolet light.

15. A method of detecting toner fade of a given toner in an electrophotographic imaging device, the method comprising:

providing an energy source configured to produce light having a predetermined wavelength;

providing a support surface on which a toner area is movably supportable, and which is substantially reflective with respect to the light produced by the energy source, wherein the support surface is substantially white;

depositing a toner area on the support surface, wherein the toner has a given color;

producing light having the predetermined wavelength, wherein the given color is substantially non-reflective with respect to the light;

directing at least a portion of the light toward the toner area; and, looking for light reflected from the toner area.

16. An apparatus for detecting toner fade in an electrophotographic imaging device, the apparatus comprising:

a support surface configured to movably support at least one toner area, wherein the support surface is configured to substantially reflect electromagnetic energy;

at least one energy source configured to produce electromagnetic energy, and to direct at least a portion of the electromagnetic energy toward the at least one toner area; and, at least two energy detectors, each detector configured to detect relative intensity of electromagnetic energy that falls within an associated range of wavelengths, wherein the energy detectors are further configured to detect intensity of electromagnetic energy reflected by the at least one toner area.

17. An apparatus for detecting toner fade in an electrophotographic imaging device, the apparatus comprising:

a support surface configured to movably support at least one toner area, wherein the support surface is configured to substantially reflect electromagnetic energy;

at least one light source configured to produce light of a predetermined wavelength, and to direct at least a portion of the light toward the at least one toner area;

at least one light detector, each detector configured to detect relative intensity of light that falls within an associated range of wavelengths, wherein each light detector is further configured to detect intensity of light reflected by the at least one toner area; and, a plurality of optical gates configured to selectively control the passage light therethrough.

18. The apparatus of claim 17, and further comprising a plurality of energy-transmitting conduits, wherein each of the plurality of optical gates is connected to at least one light source by way of an associated energy-transmitting conduit.

19. The apparatus of claim 17, and further comprising a plurality of energy-transmitting conduits, wherein each of the plurality of optical gates is connected to at least one light detector by way of an associated energy-transmitting conduit.

* * * * *